US007419318B2

(12) United States Patent
Hayakawa

(10) Patent No.: US 7,419,318 B2
(45) Date of Patent: Sep. 2, 2008

(54) RECORDING MEDIUM CONVEYING DEVICE

(75) Inventor: Kazushi Hayakawa, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 11/223,024

(22) Filed: Sep. 12, 2005

(65) Prior Publication Data

US 2006/0056899 A1 Mar. 16, 2006

(30) Foreign Application Priority Data

Sep. 16, 2004 (JP) ..... 2004-269868
Sep. 16, 2004 (JP) ..... 2004-269881

(51) Int. Cl.
*B41J 13/10* (2006.01)

(52) U.S. Cl. ..... 400/605; 400/642; 347/104

(58) Field of Classification Search ..... 400/605, 400/618, 619, 614, 224, 642, 419, 646, 647.1, 400/611–612.2, 609–610.4; 347/104, 14, 347/16, 101, 105; 101/40.1, 40, 43, 92, 138, 101/176; 346/136; 226/109, 137, 138, 180; 428/32.1

See application file for complete search history.

(56) References Cited

U.S. PATENT DOCUMENTS 4,494,744 A * 1/1985 Povio et al. ..... 271/34
4,916,466 A * 4/1990 Coste ..... 346/136
4,927,277 A * 5/1990 Niikawa ..... 400/56
5,026,042 A * 6/1991 Miller ..... 271/119
5,328,280 A * 7/1994 Ito ..... 400/596
5,527,029 A * 6/1996 Bortolotti et al. ..... 271/124
5,651,620 A * 7/1997 Paranjpe ..... 400/120.02
6,078,345 A * 6/2000 Yamakawa et al. ..... 347/218
6,330,423 B1 * 12/2001 Kitazawa ..... 399/392
6,471,429 B1 * 10/2002 Isobe et al. ..... 400/582
6,921,222 B2 * 7/2005 Ng et al. ..... 400/618
7,052,126 B2 * 5/2006 Suzuki et al. ..... 347/104
7,120,381 B2 * 10/2006 Matsuoka ..... 399/385
2005/0207813 A1 * 9/2005 Takabatake et al. ..... 400/88

FOREIGN PATENT DOCUMENTS

JP 401139465 A * 5/1989
JP 406336038 A * 12/1994

* cited by examiner

*Primary Examiner*—Matthew Luu
*Assistant Examiner*—Joshua M Dubnow
(74) *Attorney, Agent, or Firm*—Finnegan, Henderson, Farabow, Garrett & Dunner, L.L.P.

(57) ABSTRACT

A recording medium conveying device comprising: a master roll holder to hold a master roll of a recording medium; a platen to support the recording medium supplied from the master roll holder in an image recording section; a conveyance roller positioned upstream of the platen to convey the recording medium by adding driving force to the recording medium and a guide positioned near the platen to guide the recording medium, wherein the guide changes an angle of the recording medium against the platen according to a stiffness of the recording medium.

16 Claims, 3 Drawing Sheets

RECORDING MEDIUM CONVEYING DEVICE

This application is based on Japanese Patent Application Nos. 2004-269868 and 2004-269881 filed on Sep. 16, 2004 in Japanese Patent Office, the entire content of which is hereby incorporated by reference.

BACKGROUND OF THE INVENTION

The present invention relates to a recording medium conveying device, particularly to a recording medium conveying device which conveys a recording medium in accordance with image recording.

An image recording apparatus such as an ink jet printer is equipped with a recording medium conveying device which conveys a recording medium in accordance with image recording (see the Patent Documents 1 and 2, for examples.) The recording medium conveying device has a master roll holding section that holds the master roll of the recording medium upstream of the platen which is positioned in an image recording area of the image recording apparatus, and it also has an ejecting section that ejects the recording medium after recording an image downstream of the platen.

If the recording medium is lifted in this operation, the distance between the recording head and the recording medium becomes non-uniform, resulting in image quality degradation. Accordingly, the recording medium conveying device conveys the recording medium along the platen so as to maintain flatness.

[Patent Document 1] Tokkai No. 2000-326572

[Patent Document 2] Tokkai No. 2003-137464

However, an ink jet printer may record images on various different kinds of recording media and, because the stiffness of a recording medium is different from type to type, the recording medium may be lifted on the platen depending on its stiffness.

For example, a recording medium with high stiffness can be conveyed smoothly without being in tension because of its high stiffness, but a recording medium with low stiffness cannot be conveyed at a stable feed rate if no tension is added to the medium. Accordingly, if the conveyance path is so designed that the recording medium is tilted upward in the traveling direction when it enters the platen, tension is added by the weight of the recording medium itself. However, if a recording medium with high stiffness is conveyed on this conveyance path, there is a possibility that the recording medium is lifted from the platen because of its stiffness when it transfers from the tilted portion onto the platen. On the other hand, when the recording medium is ejected after having an image recorded, a recording medium with high stiffness can be ejected smoothly without added tension because of its high stiffness. In case of ejecting a recording medium with low stiffness, however, if no tension is added, buckling may be caused by the conveyance resistance to the recording medium when it is separated from the platen. This buckling may cause the recording medium to rub against the discharge surface of the recording head, possibly resulting in recording medium jamming.

If the conveyance path is so designed that the recording medium is tilted downward in the traveling direction when the recording medium separates from the platen, tension is added by the weight of the recording medium itself. However, if a recording medium with high stiffness is conveyed on this conveyance path, the recording medium may be lifted from the platen because of its form maintaining force due to the stiffness when the recording medium hangs down, and may rub against the discharge surface of the recording head, possibly resulting in recording medium jamming.

SUMMARY OF THE INVENTION

An object of the present invention is to ensure conveyance accuracy and smooth ejection of recording medium having different stiffness.

A recording medium conveying device comprising: a master roll holder to hold a master roll of a recording medium; a platen to support the recording medium supplied from the master roll holder in an image recording section; a conveyance roller positioned upstream of the platen to convey the recording medium by providing driving force to the recording medium and a guide positioned near the platen to guide the recording medium, wherein the guide changes the angle of the recording medium against the platen according to the stiffness of the recording medium.

A recording medium conveying device as set forth in an embodiment of the invention (the first embodiment) comprises; a master roll holding section that holds a master roll of the recording medium, a conveyance roller located upstream of the platen of the image recording apparatus, that adds a driving force to the recording medium and conveys it, an entrance section that guides the recording medium from the master roll holding section to the conveyance roller; and the entry angle with the platen in the entrance section at which the recording medium enters the conveyance roller, is freely changeable corresponding to the stiffness of the recording medium.

According to an embodiment of the invention, since the entry angle is changed in the entrance section corresponding to the stiffness of the recording medium, the entry angle suitable for each kind of recording medium can be set. Accordingly, the entry angle can be so changed as to add tension for a recording medium with low stiffness, and the entry angle can be so changed as to prevent lifting from the platen and maintain flatness of a recording medium with high stiffness. Thus, even for recording media with different stiffness, conveyance accuracy can be ensured.

A recording medium conveying device as set forth in another embodiment of the invention (the second embodiment) comprises; a master roll holding section that holds a master roll of the recording medium, a conveyance roller located downstream of the master roll holding section that adds a driving force to the recording medium and conveys it to the platen of the image recording apparatus, an ejection section that ejects the recording medium after recording downstream of the platen, and the tilt angle of the recording medium in the ejection section is freely changeable corresponding to the stiffness of the recording medium.

According to an embodiment of the invention, since the tilt angle is changed in the ejection section corresponding to the stiffness of the recording medium, a tilt angle suitable for each recording medium can be set. Accordingly, the tilt angle can be so changed as to add tension to a recording medium with low stiffness, and the tilt angle can be so changed as to prevent lifting from the platen and to maintain flatness of the recording medium with high stiffness. Thus, even for a recording medium with different stiffness, smooth ejection can be ensured.

According to the present invention, since the entry angle or tilt angle can be so changed that tension is added to a recording medium with low stiffness, and since the entry angle or tilt angle can be so changed that lifting from the platen is prevented and flatness is maintained of a recording medium with high stiffness, conveyance accuracy and smooth ejection can be ensured for recording media with different stiffness.

DETAILED DESCRIPTION OF THE PREFERRED EMBODIMENT

Figure 1:
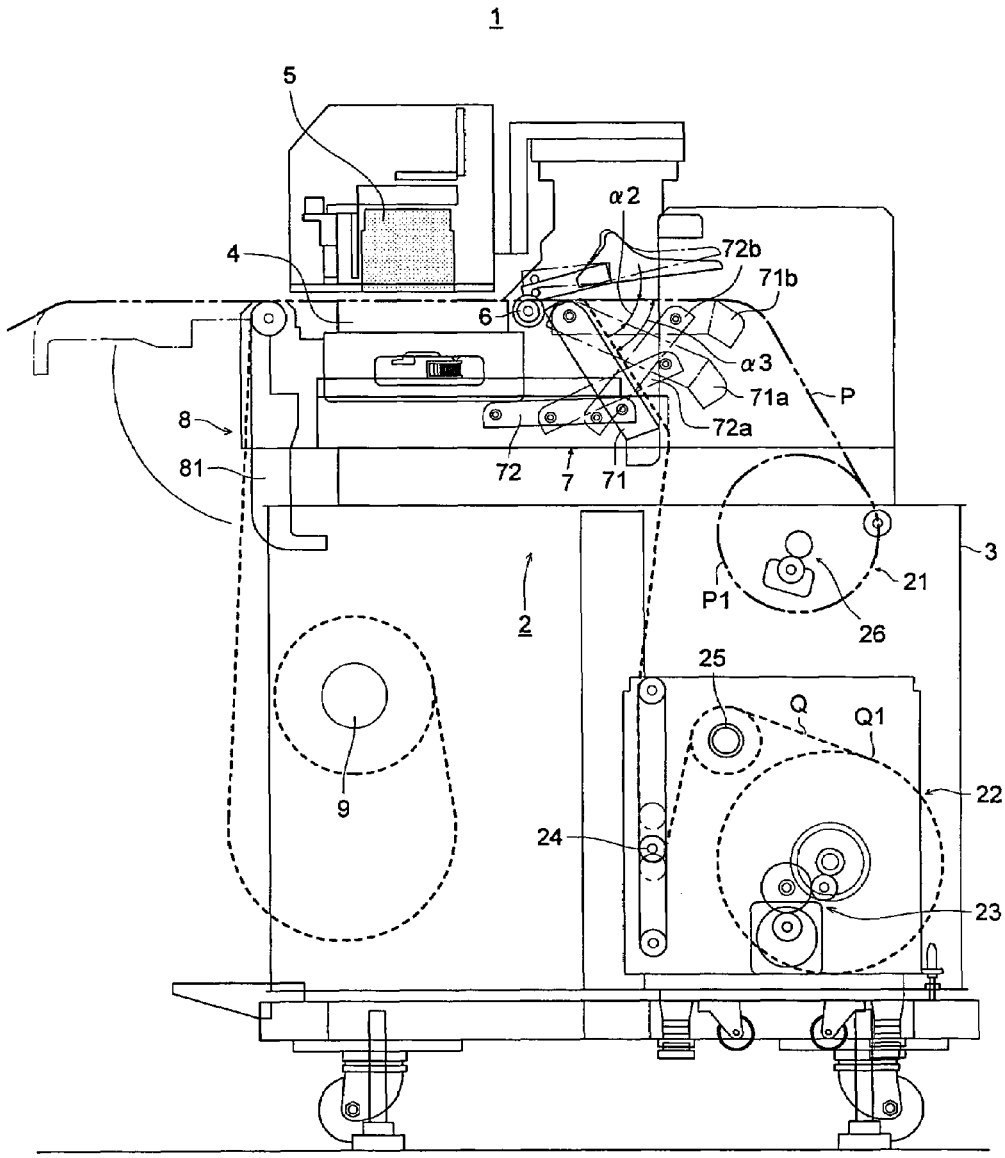
FIG. 1 is a schematic structural view of an image recording apparatus equipped with a recording medium conveying device according to this embodiment.

Further preferred embodiments of the invention to solve the above problems will now be explained.

In the recording medium conveying device of the invention, the guide is structured so that the entry angle or tilt angle can be so changed that the recording medium becomes parallel to the platen for a recording medium with high stiffness, and that the recording medium with low stiffness becomes perpendicular to the platen.

When the recording medium with high stiffness is conveyed, according to the embodiment of the invention, the entry angle and/or tilt angle are/is so changed that the recording medium becomes parallel to the platen, which means that a conveyance path and/or ejection path without a tilt are/is formed in immediately upstream and/or downstream of the platen. When there is no tilt in the path like the above, lifting of a recording medium with high stiffness from the platen can be prevented.

On the other hand, when a sheet of recording medium with low stiffness is conveyed, the entry angle is so changed that the recording medium becomes perpendicular to the platen, which means that tension is added to the recording medium upstream of the conveyance roller by its own weight. When tension is added to the recording medium with low stiffness like the above, feed rate can be kept stable. In the ejection path, on the other hand, when a sheet of recording medium with low stiffness is conveyed, the tilt angle is so changed that the recording medium becomes perpendicular to the platen, which means that tension is added to the recording medium downstream of the platen by its own weight. When tension is added to the recording medium with low stiffness like the above, smooth ejection is ensured without buckling.

In the recording medium conveying device of the first embodiment, multiple master roll holding sections are installed vertically, and the upper master roll holding section holds a master roll of recording medium with higher stiffness than the recording medium held in a lower master roll holding section.

Generally speaking, since sheets of recording medium with low stiffness are more frequently used than sheets of recording medium with high stiffness, it requires frequent master roll changes, as a matter of course. In addition, since a master roll of recording medium is very heavy, changing the roll becomes difficult if the master roll holding section is located high in the apparatus. If the recording medium with stiffness higher than that of recording medium held in the lower holding section is held in the upper master roll holding section, which means that if the recording medium roll with low stiffness requiring more frequent changes is located lower, operator burden of the change work can be reduced.

The recording medium conveying device in the second embodiment has a winding section positioned below the ejection section to wind recording medium when the tilt angle is changed to vertical.

According to the embodiment, since the winding section winds the recording medium under the ejection section, a recording medium with low stiffness can be wound after tension is provided. Generally, a recording medium with low stiffness is more frequently used and becomes easier to handle in a state after being wound like this.

The recording medium conveying device of the invention is provided with a control section that controls the entrance section and/or the ejection section so that the entry angle and/or tilt angle correspond(s) to the stiffness of the recording medium.

According to the invention, since the control section controls the entrance section so that the entry angle corresponds to the stiffness of the recording medium, automatic entry angle changes become possible. On the other hand, since control section controls the ejection section so that the tilt angle corresponds to the stiffness of the recording medium, automatic tilt angle change in the ejection path becomes possible.

Next, the first embodiment and the second embodiment will be explained in detail.

The First Embodiment

The first embodiment is the recording medium conveying device equipped with an entrance section in which the entry angle with the platen, at which the recording medium enters the conveyance roller, is freely changeable corresponding to the stiffness of the recording medium, which is described hereunder.

The recording medium conveying device of the present invention is described hereunder, using the attached figures.

FIG. 1 is the image recording apparatus 1 equipped with the recording medium conveying device of this embodiment. As shown in FIG. 1, the image recording apparatus 1 is equipped with a case 3 that encloses the recording medium conveying device 2, platen 4 that is supported above the case 3 and supports the recording medium P or Q horizontally from beneath, and recording head 5 that is located above the platen 4 and emits ink onto the recording medium P or Q supported by the platen 4.

The recording medium conveying device 2 has two master roll holding sections 21 and 22, located vertically, each of that holds each master roll P1 and Q1 of the recording media P and Q. Among the two master roll holding sections 21 and 22, the upper master roll holding section 21 holds the master roll P1 of the recording medium P having higher stiffness than the recording medium Q held in the lower master roll holding section 22.

Figure 2:
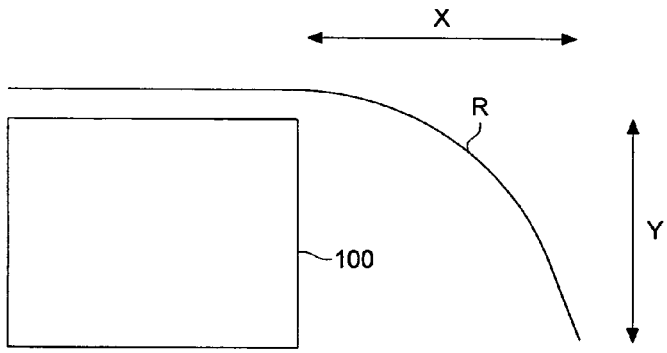
FIG. 2 explains the stiffness of the recording medium conveyed on the recording medium conveying device in FIG. 1.

In the meantime, stiffness of recording medium is explained here. "Stiffness" is generally understood as one of the indexes for evaluating the strength as to how an article will not bend against a bending force, and its quantitativeness is in a range of comparative relativity. The quantitative value of the stiffness is measured for example by a method shown in FIG. 2. Different types of recording media R of the same size (A4, for example) are prepared. Each type of the recording media is placed on a level table 100. In this procedure, the recording medium R shall be placed on the table 100 so that approximately a half length of the recording medium R projects out of the table 100. The portion projecting out of the table 100 hangs down by its own weight. Provided that the horizontal distance from the tip of this hanging recording medium to the table 100 is X and the vertical distance from the tip to the upper surface of the table 100 is Y, the quantitative value is expressed as Y/X. For example, in case of a recording medium having little stiffness such as tarpaulin, X becomes smaller and so the quantitative value approximates to ∞; in case of a recording medium having high stiffness such as coated paper, Y becomes smaller and so the quantitative value approximates to 0.

The degree of stiffness of the recording media P and Q are judged by this measurement method, and the master roll P1 of the recording medium P having high stiffness is held in the upper master roll holding section 21 and the master roll Q1 of the recording medium Q having low stiffness is held in the lower master roll holding section 22 as shown in FIG. 1.

The lower master roll holding section 22 is equipped with an unwinding section 23 that unwinds the master roll Q1 in accordance with the feed rate of the recording medium Q, dancer roller 24 that is moved up and down by the unwound recording medium Q, and guide roller 25 that guides the recording medium Q from the master roll Q1 to the dancer roller 24. This master roll holding section 22 is constructed as a separate unit, and so it can be removed freely from the case of the image recording apparatus 1.

The upper master roll holding section 21 is equipped with an oil damper 26 that adds load torque to the master roll P1 of the recording medium P.

Then, the recording medium conveying device 2 is equipped with a conveyance roller 6 upstream of the platen 4 that adds drive force to the recording medium P or Q to convey them. In the upstream position of the conveyance roller 6, there is provided an entrance section 7 that guides the recording medium P or Q from the master roll holding section 21 or 22 to the conveyance roller 6.

The entrance section 7 is equipped with an entry angle changing member 71 as the guide of the entrance that supports the recording medium P or Q from below and also changes the entry angle against the conveyance roller 6. The entry angle changing member 71 swings around its one end on the conveyance roller 6 side as a swinging axis. In addition, the corners of the other end of the entry angle changing member 71 are made arc-shaped.

The entrance section 7 is also equipped with an adjusting member 72 that is located under the conveyance roller 6 and adjusts the tilt angle of the entry angle changing member 71. The tip of the adjusting member 72 is connected with the other end of the entry angle changing member 71. On the other hand, the base end of the adjusting member 72 rotates as it travels horizontally. When the base end of the adjusting member 72 travels horizontally, the entry angle changing member 71 is swung because the tip of the adjusting member 72 is connected with the other end of the entry angle adjusting member 71. In this embodiment, the base end of the adjusting member 72 is designed to stop at three points within its traveling range so that the entry angle can be changed at three steps by the entry angle changing member 71.

In the above description, the entry angle means an angle of the recording medium P or Q with the flat surface of the platen 4, that is, the horizontal surface at which the recording medium enters the conveyance roller 6. The entry angle α1 at the first step is set at 0 up to 45 degrees excluding 45 degrees, the entry angle α2 at the second step is set at 45 up to 76 degrees excluding 76 degrees, and the entry angle α3 at the third step is set at 76 to 90 degrees. In FIG. 1, the entry angle changing member 71 and adjusting member 72 shown in solid line represent the third step setting at the entry angle α3, the entry angle changing member 71*a* and adjusting member 72*a* shown in alternate long and short dash line represent the second step setting at the entry angle α2, and the entry angle changing member 71*b* and adjusting member 72*b* shown in alternate long and short dash line represent the first step setting at the entry angle α1. Since the entry angle α1 at the first step is set to 0 degree in this embodiment, the entry angle α1 is not shown in FIG. 1. These entry angles can be changed corresponding to the stiffness of the recording media P and Q. The entry angle α1 at the first step is employed for the recording medium the quantitative value of which mentioned above (Y/X) is more than 0 but less than 1 (for example, coated paper, glossy paper, polycarbonate, etc.); the entry angle α2 at the second step is employed for the recording medium the quantitative value of which is more than 1 but less than 4 (for example, supported glossy vinyl chloride, PET, Yupo synthetic paper, etc.); and the entry angle α3 at the third step is employed for the recording medium the quantitative value of which is more than 4 (for example, tarpaulin, vinyl chloride sheet, etc.).

A recording medium the quantitative value of which is less than 1 is generally judged to have high stiffness. When a recording medium having high stiffness like this is conveyed, if the entry angle is so changed that the recording medium becomes parallel to the platen 4, a conveyance path without a tilt is formed in immediately upstream of the platen 4, which is preferable because lifting of the recording medium with high stiffness on the platen 4 can be prevented. That is, a preferable entry angle α1 of the first step setting is 0 degree.

On the other hand, recording medium the quantitative value of which is more than 4 is generally judged to have low stiffness. When a recording medium having low stiffness like this is conveyed, if the entry angle is so changed that the recording medium becomes perpendicular to the platen 4, it is preferable because tension is added to the recording medium upstream of the platen 4 by its own weight. That is, a preferable entry angle α3 of the third step setting is 90 degrees.

Then, downstream of the platen 4 of the recording medium conveying device 2, there is provided an ejection guide 81 that forms an ejection path of the recording media P and Q. The ejection guide 81 is constructed to swing around its one end on the platen 4 side as a swinging axis so that its position can be switched to the horizontal position (solid line in FIG. 1) or vertical position (alternate long and short dash line in FIG. 1). The ejection guide 81 is set to the horizontal position for ejecting the recording medium P with high stiffness and to the vertical position for ejecting the recording medium Q with low stiffness.

Under the ejection guide 81, there is also provided a winding section 9 that winds up the recording section Q with low stiffness.

Figure 3:
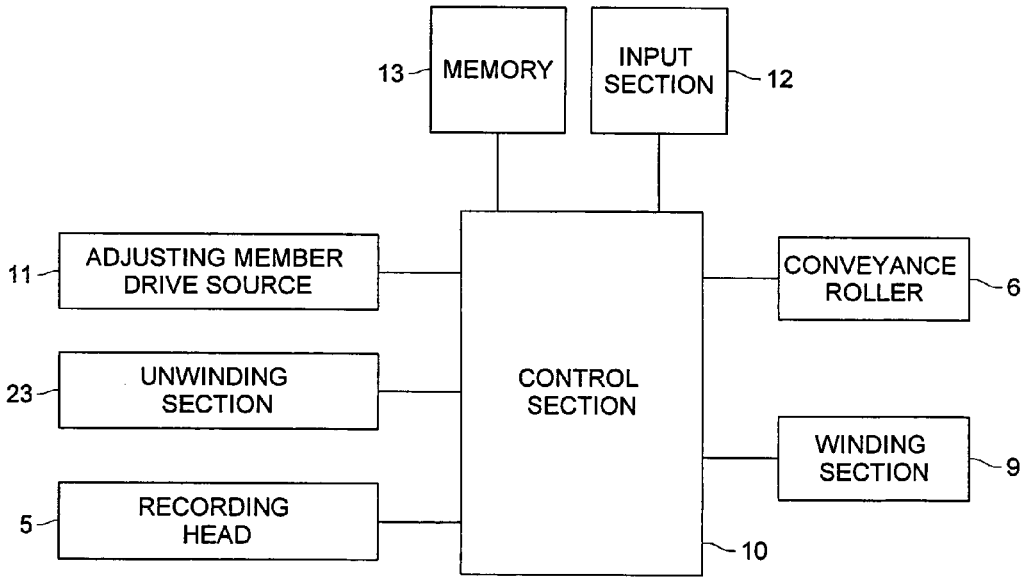
FIG. 3 is a block diagram showing the structure of the major control of the first embodiment of the image recording apparatus 1 in FIG. 1.

FIG. 3 is a block diagram showing the construction of the major control of the image recording apparatus 1. As shown in FIG. 3, the image recording apparatus 1 is equipped with a control section 10 that controls each drive source. The control section 10 is electrically connected with an adjusting member drive source 11 for moving the adjusting member 72 of the entrance section 7 horizontally, input section 12 to which an instruction of the operator is inputted, unwinding section 23, recording head 5, conveyance roller 6, winding section 9, and memory 13. Other sections than the above such as drive sections of the image recording apparatus 1 are also connected with the control section 10. The control section 10 controls each device and component in accordance with the control program and control data stored in the memory 13.

Control data includes, for example, angle data that relate the afore-mentioned entry angles α1, α2 and α3 of each step with the types of the recording media P and Q.

Next, the operation of the recording medium conveying device 2 of this embodiment is described hereunder.

For conveying the recording medium P, the operator pulls out the recording medium P from the master roll P1 held in the master roll holding section 21 as much as it can be conveyed by the conveyance roller 6. In this procedure, the operator inputs the type of the recording medium P from the input section 12. Upon this input, the control section 10 determines the entry angle based on the angle data in the memory 13 and the input data. When the first step entry angle α1 is selected, for example, the control section 10 controls the adjusting member drive source 11 to move the adjusting member 72 up to a position where the tilt angle of the entry angle changing member 71 becomes the first step entry angle α1 and stop it there. Here, the operator sets the ejection guide 81 to the horizontal position.

When the adjusting member 72 has stopped and the ejection guide 81 has been set, the operator instructs to start image recording from the input section 12. Based on the input, the control section 10 controls the recording head 5 and conveyance roller 6 to emit ink onto the recording medium P to record images, while feeding the recording medium P intermittently. The recording medium P recorded with images is conveyed along the ejection guide 81, keeping its horizontal position, and placed on a table (not shown).

On the other hand, for conveying the recording medium Q, the operator pulls out the recording medium Q from the master roll Q1 held in the lower master roll holding section 22 via the guide roller 25 and dancer roller 24 as much as it can be conveyed by the conveyance roller 6. In this procedure, the operator inputs the type of the recording medium Q from the input section 12. Upon this input, the control section 10 determines the entry angle based on the angle data in the memory 13 and the input data. When the third step entry angle α3 is selected, for example, the control section 10 controls the adjusting member drive source 11 to move the adjusting member 72 up to a position where the tilt angle of the entry angle changing member 71 becomes the third step entry angle α3 and stops it there. Here, the operator sets the ejection guide 81 to the vertical position.

When the adjusting member 72 has stopped and the ejection guide 81 has been set, the operator instructs to start image recording from the input section 12. Based on the input, the control section 10 controls the recording head 5, conveyance roller 6, unwinding section 23 and winding section 9 to emit ink onto the recording medium Q to record images, while feeding the recording medium Q intermittently. The recording medium Q recorded with images is conveyed along the ejection guide 81, while hanging down vertically, and wound on the winding section 9.

As described above, according to the recording medium conveying device 2 of this embodiment, the entry angle can be set suitable for different types of recording media P and Q because the entry angle is changed by the entrance section 7 corresponding to the stiffness of the recording media P and Q. Accordingly, the entry angle can be so changed that tension is added for the recording medium Q with low stiffness, and the entry angle can be so changed that lifting from the platen 4 is prevented and flatness is maintained for the recording medium P with high stiffness. Thus, conveyance accuracy can be ensured for the recording media P and Q with different stiffness.

In addition, since the control section 10 controls the entrance section 7 so that the entry angle becomes corresponding to the stiffness of the recording media P and Q, automatic entry angle change becomes possible.

The Second Embodiment

The second embodiment is the recording medium conveying device equipped with the ejection section in which the tilt angle in the ejection path is freely changeable corresponding to the stiffness of the recording medium, which is described hereunder.

Downstream of the platen 4 of the recording medium conveying device 2, there is provided an ejection section 8 that forms an ejection path of the recording media P and Q. The ejection section 8 is equipped with an ejection guide 81 that supports the recording medium P or Q from below and forms the ejection path, and an ejection guide drive source 82 that swings the ejection guide 81 around its one end on the platen 4 side as a swinging axis (see FIG. 3).

The ejection guide 81 is swung by the ejection guide drive source so that its position can be switched to two positions: the horizontal position (sold line in FIG. 1) or vertical position (alternate long and short dash line in FIG. 1). Accordingly, the ejection section 8 changes the tilt angle in the ejection path of the recording media P and Q corresponding to the stiffness of the recording media P and Q.

In the above description, the tilt angle means an angle of the recording media P and Q with the flat surface of the platen 4, that is, the horizontal surface at which the recording medium passes the ejection guide 81. For example, the first tilt angle α1' when the ejection guide 81 is positioned flat is 0 degree. The second tilt angle α2' when it is positioned vertical is 90 degrees. This tilt angle can be changed corresponding to the stiffness of the recording media P and Q. The tilt angle α1' is employed for the recording medium the quantitative value of which mentioned above (Y/X) is more than or equal to 0 but less than 4 (for example, coated paper, glossy paper, polycarbonate, supported glossy vinyl chloride, PET, Yupo synthetic paper, etc.); and the tilt angle α2' is employed for the recording medium the quantitative value of which is more than 4 (for example, tarpaulin, vinyl chloride sheet, etc.).

It is preferable for smooth conveyance of the recording media P and Q that the surface of the ejection guide 81 is positioned lower than the surface of the platen 4 being arc-shaped with its swelling surface facing upward.

The winding section 9 is installed under the ejection section 8 to wind the recording medium Q when the tilt angle of the ejection path is changed to 90 degrees.

Figure 4:
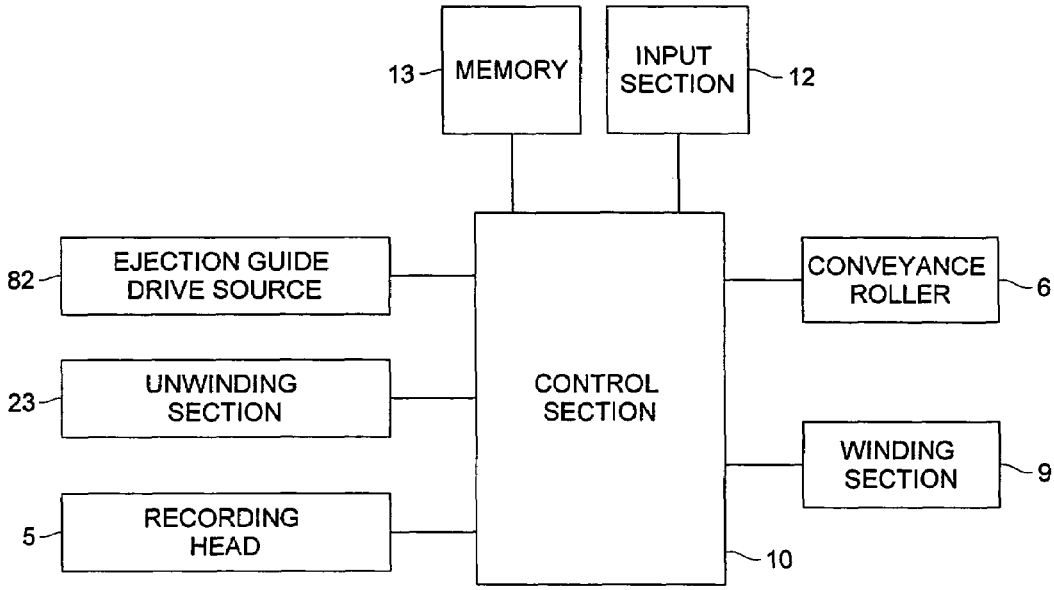
FIG. 4 is a block diagram showing the structure of the major control of the second embodiment of the image recording apparatus 1 in FIG. 1.

FIG. 4 is a block diagram showing the construction of the major control of the image recording apparatus 1. As shown in FIG. 4, the image recording apparatus 1 is equipped with a control section 10 that controls each drive source. The control section 10 is electrically connected with the input section 12 to which an instruction of the operator is inputted, unwinding section 23, recording head 5, conveyance roller 6, winding section 9, ejection guide drive source 82, and memory 13. Other sections than the above such as drive sections of the image recording apparatus 1 are also connected with the control section 10. The control section 10 controls each device and component in accordance with the control program and control data stored in the memory 13.

Control data includes, for example, angle data that relate the afore-mentioned first tilt angles α1' and second tilt angle α2' with the types of the recording medium.

Next, the operation of the recording medium conveying device 2 of this embodiment is described hereunder.

For conveying the recording medium P, the operator pulls out the recording medium P from the master roll P1 held in the master roll holding section 21 as much as it can be conveyed by the conveyance roller 6. In this procedure, the operator inputs the type of the recording medium P from the input section 12. Upon this input, the control section 10 determines the tilt angle of the ejection path based on the angle data in the memory 13 and the input data. When the first tilt angle $\alpha 1'$ is selected, for example, the control section 10 controls the ejection guide drive source 82 to swing the ejection guide 81 so that the ejection path is tilted at the first tilt angle $\alpha 1'$ and stop it there. Thus, with the first tilt angle $\alpha 1'$, the recording medium P is ejected through the ejection path where the recording medium P is parallel to the platen 4.

Here, the operator moves the adjusting member 72 horizontally so that the tilt angle of the entry angle changing member 71 of the entrance section 7 becomes corresponding to the recording medium P.

When the adjusting member 72 has moved and the ejection section 8 has been set, the operator instructs to start image recording from the input section 12. Based on the input, the control section 10 controls the recording head 5 and conveyance roller 6 to emit ink onto the recording medium P to record images, while feeding the recording medium P intermittently. The recording medium P recorded with images is conveyed along the ejection section 8, keeping its horizontal position, and placed on a table (not shown).

On the other hand, for conveying the recording medium Q, the operator pulls out the recording medium Q from the master roll Q1 held in the lower master roll holding section 22 via the guide roller 25 and dancer roller 24 as much as it can be conveyed by the conveyance roller 6. In this procedure, the operator inputs the type of the recording medium Q from the input section 12. Upon this input, the control section 10 determines the tilt angle of the ejection path based on the angle data in the memory 13 and the input data. When the second tilt angle $\alpha 2'$ is selected, for example, the control section 10 controls the ejection guide drive source 82 to swing the ejection guide section 81 so that the ejection path is tilted at the second tilt angle $\alpha 2'$ and stop it there. Thus, with the second tilt angle $\alpha 2'$, the recording medium Q is ejected through the ejection path where the recording medium Q is perpendicular to the platen 4.

Here, the operator moves the adjusting member 72 horizontally so that the tilt angle of the entry angle changing member 71 of the entrance section 7 becomes corresponding to the recording medium Q.

When the adjusting member 72 has moved and the ejection section 8 has been set, the operator instructs to start image recording from the input section 12. Based on the input, the control section 10 controls the recording head 5, conveyance roller 6, unwinding section 23 and winding section 9 to emit ink onto the recording medium Q to record images, while feeding the recording medium Q intermittently. The recording medium Q recorded with images is conveyed along the ejection section 8, while hanging down vertically, and wound on the winding section 9.

As described above, according to the recording medium conveying device 2 of the second embodiment, the tilt angle can be set suitable for different types of recording media P and Q because the tilt angle is changed by the ejection section 8 corresponding to the stiffness of the recording media P and Q. Accordingly, the tilt angle can be so changed that tension is added for the recording medium Q with low stiffness, and the tilt angle can be so changed that lifting from the platen 4 is prevented and flatness is maintained for the recording medium P with high stiffness. Thus, smooth ejection can be ensured for the recording media P and Q with different stiffness.

In addition, when the recording medium P with high stiffness is conveyed, the tilt angle is so changed that the recording medium P becomes parallel to the platen 4, which means that a conveyance path without a tilt is formed in immediately upstream of the platen 4. When there is no tilt in the path like the above, lifting of the recording paper P with high stiffness from the platen 4 can be prevented.

On the other hand, when the recording medium Q with low stiffness is conveyed, the tilt angle is so changed that the recording medium Q becomes perpendicular to the platen 4, which means that tension is added to the recording medium Q downstream of the platen 4 by the own weight. When tension is added to the recording medium Q with low stiffness like the above, generation of buckling can be prevented and accordingly smooth ejection can be ensured.

Since the winding section 9 located under the ejection section 8 winds up the recording medium Q with low stiffness, winding up the recording medium Q while adding tension to it becomes possible. Generally speaking, recording medium Q with low stiffness is used more frequently, but winding it up like the above facilitates easy handling.

In addition, since the control section 10 so controls the ejection section 8 that the tilt angle corresponds to the stiffness of the recording media P and Q, automatic tilt angle change of the ejection path becomes possible.

Needless to say, the present invention is not limited to the above embodiments but is modifiable as needed.

For example, although the recording medium conveying device 2 is equipped with two master roll holding sections 21 and 22 in the first embodiment, three or more master roll holding sections can be provided. Even in this case, it is preferable that a master roll of a recording medium with higher stiffness is held in an upper master roll holding section than a master roll holding section where a master roll of a recording medium with lower stiffness is held. In this construction, it is preferable that the master roll section in the lowest position is constructed as a separate unit and can be removed freely from the case like the master roll section 22 in this embodiment.

Further, in both the first embodiment and the second embodiment, guides the inclination angle of which is changeable are mounted on the entrance section and the ejection section, however they can be mounted on either the entrance section or the ejection section. The adjusting member drive source 11 for the entrance guide drive is connected to the control section 10 electrically in the first embodiment, and the ejection guide drive source 82 for the ejection guide drive is connected to the control section 10 electrically in the second embodiment. However, both the drive sources can be connected to the control section 10.

In addition, although the entry angle is changed at three steps in the first embodiment, changing the entry angle to the most appropriate one for each type of the recording medium is possible if the relationship between the type of recording medium and the suitable entry angle for each type is kept as the angle data. In this data, the entry angle $\alpha_n$ for each type is calculated as $\alpha_n$=a tan(Y/X) based on the quantitative value (Y/X) of each type.

In addition, although the tilt angle is changed at two steps in the second embodiment, changing the tilt angle to the most appropriate one for each type of the recording medium is possible if the relationship between the type of recording medium and the suitable tilt angle for each type is kept as the angle data. In this data, the tilt angle $\alpha n'$ for each type is calculated as $\alpha_n'$=a tan(Y/X) based on the quantitative value (Y/X) of each type.

What is claimed is:

1. A recording medium conveying device comprising:

a master roll holder to hold a master roll of a recording medium;

a platen to support the recording medium supplied from the master roll holder in an image recording section;

a conveyance roller positioned upstream of the platen to convey the recording medium by adding driving force to the recording medium; and a guide positioned near the platen to guide the recording medium, wherein the guide changes so that an angle of the recording medium on the guide relative to the platen becomes smaller as a stiffness of the recording medium becomes higher and so that an angle of the recording medium on the guide relative to a direction of gravitational force becomes smaller as a stiffness of the recording medium becomes lower.

2. The recording medium conveying device of claim 1, wherein the guide is an entrance guide positioned upstream of the platen to guide the recording medium supplied from the master roller holder to the conveyance roller and to change an entrance angle of the recording medium into the conveyance roller.

3. The recording medium conveying device of claim 2, wherein a plurality of master roll holders are arranged vertically and an upper master roll holder holds a master roll of stiffer recording medium than a recording medium held by a lower master roll holder.

4. The recording medium conveying device of claim 1, wherein the guide is an ejection guide positioned downstream of the platen to guide the recording medium on which an image has been recorded and to change an inclination angle of the recording medium in an ejection path.

5. The recording medium conveying device of claim 4, wherein when the inclination angle is changed to be vertical, a winding section to wind a recording medium is positioned below the ejection guide.

6. The recording medium conveying device of claim 1, wherein the guide changes the angle to be parallel to the platen when the recording medium is stiff and to be perpendicular to the platen when the recording medium is flexible.

7. The recording medium conveying device of claim 1, further comprising:

a controller to control the guide so that the angle of the recording media against the platen corresponds to the stiffness of the recording medium.

8. The recording medium conveying device of claim 1, comprising a plurality of master roll holders that are arranged vertically.

9. The recording medium conveying device of claim 1, comprising an upper master roll holder that holds a master roll of recording medium having a first stiffness and a lower master roll holder that holds a master roll of recording medium having a lesser stiffness than the first stiffness.

10. A recording medium conveying device comprising:

a master roll holder to hold a master roll of a recording medium;

a platen to support the recording medium supplied from the master roll holder; and a guide positioned near the platen to guide the recording medium, wherein the guide changes an angle of the recording medium on the guide relative to the platen to be parallel to the platen when the recording medium is stiff and further changes an angle of the recording medium on the guide relative to the platen to be parallel to a direction of gravitational force when the recording medium is flexible.

11. The recording medium conveying device of claim 10, further comprising a conveyance roller positioned upstream of the platen to convey the recording medium by adding driving force to the recording medium.

12. The recording medium conveying device of claim 10, wherein the guide is an entrance guide positioned upstream of the platen to guide the recording medium supplied from the master roller holder to the conveyance roller.

13. The recording medium conveying device of claim 10, wherein the guide is an ejection guide positioned downstream of the platen to guide the recording medium on which an image has been recorded in an ejection path.

14. A recording medium conveying device comprising:

a plurality of master roll holders arranged vertically, each of the master roll holder being configured to hold a master roll of a recording medium having a different stiffness;

a platen to support the recording medium supplied from one of the master roll holders; and a guide positioned near the platen to guide the recording medium, wherein the guide changes an angle of the recording medium on the guide relative to the platen to be perpendicular to the platen when the recording medium is flexible.

15. The recording medium conveying device of claim 14, wherein the guide changes an angle of the recording medium on the guide relative to the platen to be parallel to the platen when the recording medium is stiff.

16. The recording medium conveying device of claim 14, wherein the plurality of master roll holders are arranged in a lower position than the guide, and wherein an upper master roll holder holds a master roll of stiffer recording medium than a recording medium held by a lower master roll holder.

* * * * *